United States Patent [19]

Shapiro et al.

[11] 4,003,499

[45] Jan. 18, 1977

[54] PRECISION LIQUID DISPENSING DEVICE

[75] Inventors: Justin Joel Shapiro; Marion Henrietta Shapiro, both of Berkeley; John W. G. Chin, Richmond, all of Calif.

[73] Assignee: Justin Joel Shapiro, Berkeley, Calif.

[22] Filed: May 26, 1976

[21] Appl. No.: 690,274

[52] U.S. Cl. ..... 222/50; 73/425.6; 222/309; 222/383

[51] Int. Cl.[2] ..... B67D 5/22

[58] Field of Search ..... 222/50, 42, 309; 73/425.6, 425.4 P

[56] References Cited

UNITED STATES PATENTS

| | | | |
|---|---|---|---|
| 3,049,270 | 8/1962 | Maeder | 222/50 X |
| 3,810,391 | 5/1974 | Suovaniemi | 222/309 X |

*Primary Examiner*—Stanley H. Tollberg
*Assistant Examiner*—Hadd S. Lane
*Attorney, Agent, or Firm*—Herman L. Gordon

[57] ABSTRACT

A liquid dispensing burette adapted to be mounted on the top of a reagent bottle or container and having inlet and outlet conduits provided with ball check valves in communication with an upstanding burette barrel containing a plunger. The barrel has a volumetric scale and a shield member is secured to the top of the plunger and extends downwardly over the barrel. The shield member has a large window aperture for viewing the scale and has a depending vertical rod fixed therein adjacent the window aperture. A magnifying indicator is adjustably mounted on the rod and overlies the scale, and has a set screw projecting through the window aperture for adjusting the vertical indicator relative to the scale, for setting the volume to be dispensed. The magnifying indicator is engageable with a stop member at the top of the barrel to limit liquid intake produced by upward extension of the plunger in accordance with the set volume.

10 Claims, 7 Drawing Figures

PRECISION LIQUID DISPENSING DEVICE

This invention relates to burette devices for accurately dispensing liquids, and more particularly to a dispensing burette for use with a liquid container, such as a reagent bottle, or the like.

A main object of the invention is to provide a novel and improved dispensing burette which is simple in construction, which is easy to adjust for a desired liquid volume to be dispensed, which is reliable in operation, and which has corrosive, dispensing scale which is easy to read and is protected against obliteration by repeated handling or usage of the burette or by contact with chemicals.

A further object of the invention is to provide an improved precision dispensing burette which is highly flexible in use, which is inexpensive to manufacture, and which may be safely used with a wide range of liquid materials, including concentrated acids, corresive, dangerous, toxic or odoriferous reagents, strong solvents, or other hazardous liquids, all of which may be safely and instantly dispensed with volumetric pipet precision from storage containers or bottles by means of the burette apparatus of the present invention.

A stll further object of the invention is to provide an improved precision liquid dispensing device having a scale which is protected against damage or disfigurement from repeated usage of the device or exposure to chemicals, which can be volumetrically set with high accuracy, which is compact in size, and which can be readily taken apart for cleaning.

A still further object of the invention is to provide an improved precision burette dispensing device adapted to be installed on a reagent bottle or other standard liquid container, which is rugged in construction, which employs inexpensive parts, including only a few glass parts, which are well-protected by molded plastic surrounding parts, and which can be installed on a conventional container closure cap, or other closure element, by merely drilling or punching a hole in the closure element, the device being mountable in conjunction with a porous washer which serves both as an air filter and air inlet.

Further objects and advantages of the invention will become apparent from the following description and claims, and from the accompanying drawings, wherein:

Figure 1:
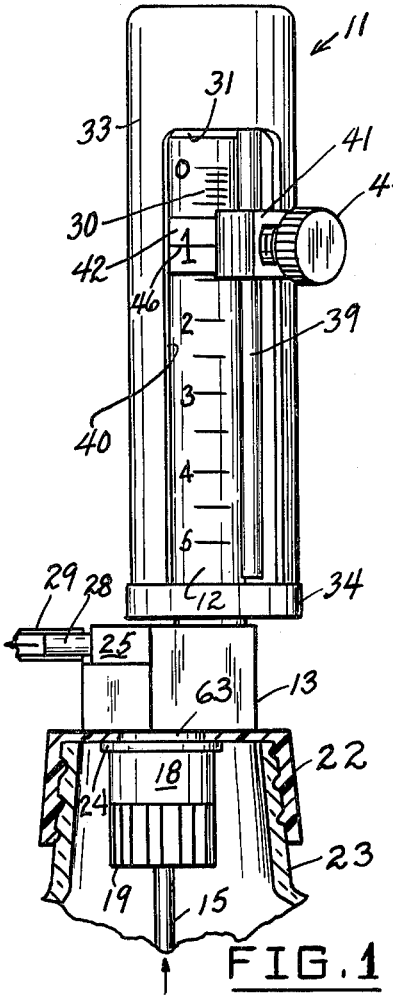
FIG. 1 is a front elevational view of an improved liquid dispensing burette device according to the present invention, shown mounted on the top of a reagent bottle, the bottle neck portion and the associated closure cap being shown in vertical cross-section.

Referring to the drawings, and more particularly to FIGS. 1, 2 and 3, 11 generally designates a preferred form of burette apparatus constructed in accordance with the present invention. The apparatus 11 comprises an upstanding cylindrical barrel member 12 of glass, or other suitable material, rigidly secured in a valve housing 13 having a depending integral reduced spout 63 in which is secured the enlarged top end portion 14 of an intake tube 15. Said enlarged top end portion 14 contains an upwardly-opening ball check valve assembly comprising a valve ball 16 and an annular ball seat 17.

Figure 2:
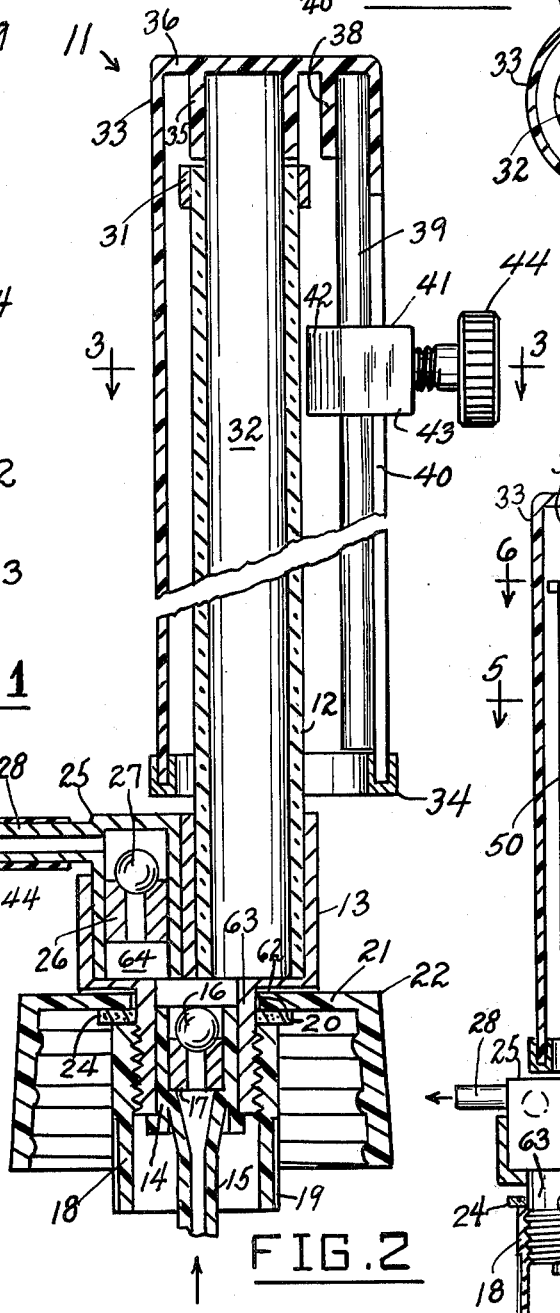
FIG. 2 is an enlarged fragmentary vertical cross-sectional view taken through the burette device and closure cap of FIG. 1.
Figure 6:
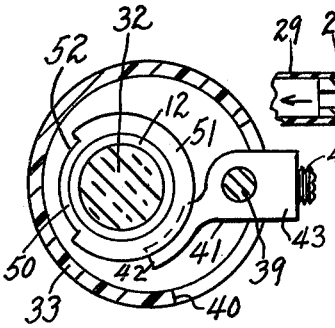
FIG. 6 is an enlarged fragmentary horizontal cross-sectional view taken substantially on line 6—6 of FIG. 4.
Figure 4:
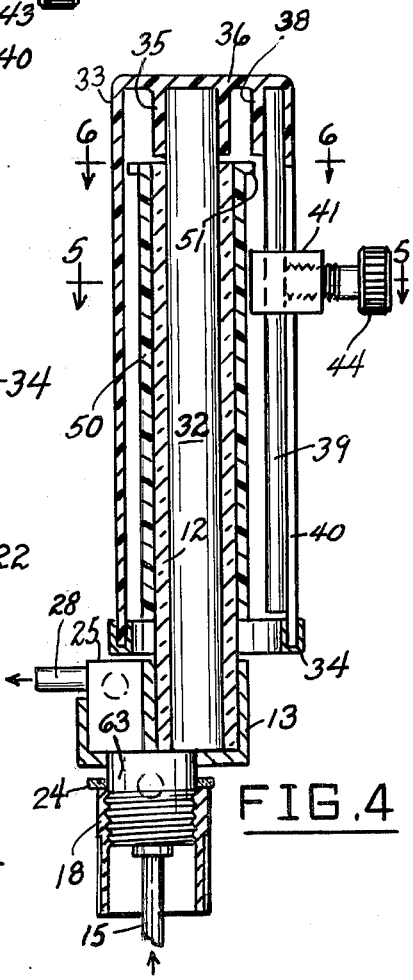
FIG. 4 is a vertical cross-sectional view taken through a modified liquid dispensing burette device according to the present invention.

Spout 63 is externally threaded so as to be threadedly engageable by a generally cylindrical internally threaded nut member 18 formed at its lower portion with finger-gripping serrations or ribs 19. As shown in FIG. 2, the spout 63 is engageable through a suitable aperture 20 formed in the top wall 21 of a closure cap 22 adapted to be threadedly engaged on the neck 23 of a conventional reagent bottle, as shown in FIG. 1. The shoulder portion above spout 63 has bottom serrations 62 defining air vent passages communicating with aperture 20. A porous ring-shaped gasket member 24 is provided between the top rim of nut member 18 and closure cap wall 21, which acts as an air filter and air inlet for the reagent bottle during the operation of the burette apparatus.

Valve housing 13 has a chamber 64 spaced laterally from barrel 12 and communicating with the space in the depending intake spout 63 above ball 16. Mounted in chamber 64 is a valve compartment 25 containing an annular ball valve seat 26 on which is disposed an upwardly-movable, suitably weighted, valve ball 27. Compartment 25 is formed at its upper portion with a laterally-directed outlet conduit element 28 communicating with the space above ball 27, as shown in FIG. 2. A suitable delivery tube 29 may be connected to conduit element 28.

Barrel 12 is inscribed, starting at its upper end portion, with a suitably calibrated volumetric scale 30. A stop ring 31 is rigidly secured around the top end of said barrel above the zero end of scale 30.

Slidably and sealingly engaged in the barrel 12 is a generally cylindrical plunger 32 which is somewhat longer than the barrel. Rigidly secured to the top end of plunger 32 is a depending guard shield 33 which may be of cylindrical or other suitable shape and which normally extends downwardly for the main height of the portion of barrel 12 exposed above valve housing 13. The bottom rim of guard shield 33 is rigidly secured in a stiffening ring 34.

Figure 3:
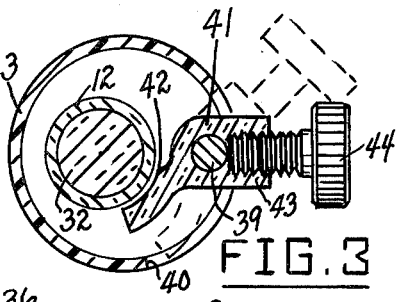
FIG. 3 is a horizontal cross-sectional view taken substantially on line 3—3 of FIG. 2.
Figure 7:
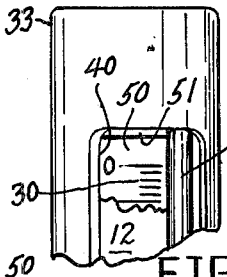
FIG. 7 is a fragmentary front elevational view of the upper portion of the modified liquid dispensing burette device of FIG. 4 with a part of the scale sleeve broken away.
Figure 5:
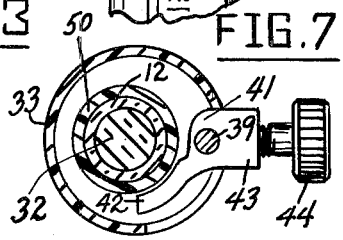
FIG. 5 is a horizontal cross-sectional view taken substantially on line 5—5 of FIG. 4.

The top end of plunger 32 is tightly received in a depending cup 35 formed integrally with the top wall 36 of guard shield 33, eccentrically thereof, and is rigidly secured in said cup. Rigidly secured in another integral depending cup element 38 adjacent the vertical wall of shield 33 is a depending rod member 39 extending downwardly for the major portion of the height of the shield 33. A relatively wide window aperture 40 is formed in shield 33, extending for the full height of scale 30, and located adjacent the depending rod 39. A transparent magnifying indicator bar element 41 is adjustably mounted on the rod 39 and has an inwardly projecting arcuately curved magnifying lens element 42 which is supported so as to be transversely positioned closely adjacent to and concentric with the scale 30 on barrel 12, as shown in FIGS. 1 and 3. Element 41 has a relatively thick body portion 43 projecting outwardly through window aperture 40 and in which is engaged a headed set screw 44 for clamping the indicator bar element 41 in adjusted position on the rod 39.

The inwardly projecting lens portion 42 cooperates with the stop ring 31 to limit the upward extension of plunger 32 in accordance with the initially set position of indicator bar element 41 relative to scale 30, established with the plunger in its lowermost position and with the fiducial mark 46 of lens 42 positioned over the point on scale 30 corresponding to the desired volume to be dispensed.

Thus, in operation, with the apparatus 11 mounted on a reagent bottle, the shield member 33 is grasped and pulled upwardly until the lens 42 engages stop ring 31. This draws the desired measured volume of reagent into barrel 12. The shield member 33 may then be pushed downwardly to its starting position, which discharges the metered quantity of reagent through the outlet tube 29 to its intended receiving receptacle.

On the intake stroke, valve ball 16 opens and valve ball 27 remains closed. On the downward stroke of plunger 32, valve ball 16 is seated and ball 27 is forced open by the liquid from barrel 12 to allow discharge thereof to the outlet tube 29.

For cleaning the apparatus, the magnifying indicator block 41 may be set to the rotated dotted view position of FIG. 3, allowing the lens 42 to pass the stop ring 31, and thereby allowing plunger 32 to be withdrawn from barrel 12.

In the modification shown in FIGS. 4, 5, 6 and 7, the scale 30 is carried on an auxiliary plastic sleeve member 50 rigidly secured on the barrel 12, said sleeve member having an integral top flange 51 which acts as a stop member, corresponding to the action of ring 31. However, flange 51 is cut away for an arcuate extent greater than that of lens 42, as shown at 52 in FIG. 6, to allow the apparatus to be taken apart for cleaning without disturbing the adjustment of the magnifying indicator bar element 41, since, by rotating the barrel portion of the apparatus relative to the plunger portion, the lens 42 may be brought into vertical registry with the notch 52 and therefore will not interfere with the withdrawal of the plunger 32 from the barrel 12.

The window aperture 40 is of sufficient width to provide clear visibility of the scale 30 to facilitate accurate setting of the magnifying indicator block 41, but still allows sufficient surface area of shield member 33 to permit manual grasping and manipulation of said shield member without contact of the user's fingers with the scale 30. This prevents rubbing off or obliteration of said scale by repeated usage of the apparatus, and also reduces the possibility of direct contact of the scale with corrosive or otherwise damaging chemicals. In prior art devices of the same general type, for example, in the device shown in U.S. Pat. No. 3,211,335 to J. J. Shapiro, or in the device shown in U.S. Pat. No. 3,940,027 to K. Marterer, the volumetric scale is exposed for direct contact by the operator's fingers while he is using the device, so that obliteration or rubbing off of parts of the scale can occur after a relatively short period of usage of the apparatus. Also, in prior art devices such as disclosed in the above-mentioned U.S. Pat. No. 3,211,335 to J. J. Shapiro, the rod for supporting the adjustable indicator member is completely exposed and can be easily bent or damaged by careless usage. Also, these prior art devices cannot be conveniently disassembled for cleaning without requiring complete readjustment for a particular desired volume to be dispensed, after re-assembly.

These and other disadvantages of the prior art devices are overcome by the apparatus of the present invention.

While certain specific embodiments of a precision liquid dispensing device have been disclosed in the foregoing description, it will be understood that various modifications within the spirit of the invention may occur to those skilled in the art. Therefore it is intended that no limitations be placed on the invention except as defined by the scope of the appended claims.

What is claimed is:

1. A burette device comprising a vertical cylindrical barrel provided at its top end with an outwardly projecting stop element, a dispensing plunger slidably and sealingly received in said barrel, a volumetric scale on said barrel, a guard shield secured to the top end of said plunger and surrounding said barrel, said guard shield being formed with a window aperture exposing said volumetric scale, a depending vertical rod in the guard shield secured to the top portion of said guard shield and depending adjacent said window aperture, an indicator element adjustably mounted on said vertical rod and having a portion thereof transversely overlying said scale and located beneath said stop element so as to engage therewith to limit upward extension of said plunger, a valve assembly including an intake conduit provided with suction check valve means and an outlet conduit having discharge check valve means, means communicatively connecting said valve assembly with the bottom end of said barrel, and means to mount said valve assembly on a closure element of a liquid container with said intake conduit projecting downwardly therefrom.

2. The burette device of claim 1, and wherein said indicator element is provided with clamp screw means engaging said rod.

3. The burette device of claim 1, and wherein said indicator element includes a body member extending through said window aperture and containing a clamping screw engaging said rod.

4. The burette device of claim 3, and wherein said guard shield is eccentrically located relative to said barrel.

5. The burette device of claim 3, and wherein said indicator element is rotatable at times on said rod to move said stop element-engageable portion from beneath said stop element to allow said plunger to be withdrawn from said barrel.

6. The burette device of claim 5, and wherein said stop element-engageable portion of the indicator element comprises a lens provided with a fiducial mark.

7. The burette device of claim 1, and wherein said guard shield comprises a generally cylindrical cup-shaped member having its axis parallel to but spaced from the axis of said barrel.

8. The burette device of claim 7, and wherein said guard shield is provided with a stiffening ring at its bottom edge, defining the bottom margin of said window aperture.

9. The burette device of claim 1, and wherein said stop element-engageable portion of the indicator element comprises an arcuately curved lens member formed to concentrically overlie said scale.

10. The burette device of claim 9, and wherein said outwardly projecting stop element is cut away sufficiently to allow said lens member at times to pass upwardly relative to said stop member.

* * * * *

UNITED STATES PATENT OFFICE

CERTIFICATE OF CORRECTION

Patent No. 4,003,499 Dated January 18, 1977

Inventor(s) Justin Joel Shapiro et al.

It is certified that error appears in the above-identified patent and that said Letters Patent are hereby corrected as shown below:

Column 1, line 12, "corrosive" should read --- a ---.

Column 1, line 26, "stll" should read --- still ---.

Signed and Sealed this

Twenty-ninth Day of March 1977

[SEAL]

*Attest:*

RUTH C. MASON
*Attesting Officer*

C. MARSHALL DANN
*Commissioner of Patents and Trademarks*